United States Patent [19]

Abiko et al.

[11] Patent Number: 4,816,835

[45] Date of Patent: Mar. 28, 1989

[54] PLANAR ANTENNA WITH PATCH ELEMENTS

[75] Inventors: Toshio Abiko; Katsuya Tsukamoto; Hiroo Inoue; Yasuhiro Fujii; Minoru Kanda; Nobuaki Miyachi, all of Kadoma, Japan

[73] Assignee: Matsushita Electric Works, Ltd., Osaka, Japan

[21] Appl. No.: 88,265

[22] Filed: Aug. 24, 1987

[30] Foreign Application Priority Data

Sep. 5, 1986 [JP] Japan ..... 61-210105

[51] Int. Cl.[4] ..... H01Q 1/38

[52] U.S. Cl. ..... 343/700 MS; 343/846

[58] Field of Search ..... 343/700 MS, 829, 846, 343/768, 795, 797

[56] References Cited

U.S. PATENT DOCUMENTS

| | | | |
|---|---|---|---|
| 3,587,110 | 6/1971 | Woodward | 343/813 |
| 3,718,935 | 2/1973 | Ranghelli et al. | 343/797 |
| 4,054,874 | 10/1977 | Ottman | 343/700 MS |
| 4,197,544 | 4/1980 | Kaloi | 343/700 MS |
| 4,263,598 | 3/1981 | Bellee et al. | 343/700 MS |
| 4,443,802 | 4/1984 | Mayes | 343/770 |
| 4,475,107 | 10/1984 | Makimoto et al. | 343/700 MS |
| 4,477,813 | 10/1984 | Weiss | 343/700 MS |
| 4,486,758 | 12/1984 | deRonde | 343/700 MS |
| 4,527,165 | 7/1985 | de Romde | 343/786 |
| 4,590,478 | 5/1986 | Powers et al. | 343/770 |
| 4,614,947 | 9/1986 | Rammas | 343/786 |

FOREIGN PATENT DOCUMENTS

| | | | |
|---|---|---|---|
| 174068 | 3/1986 | European Pat. Off. | 343/700 MS |
| 3514880 | 11/1985 | Fed. Rep. of Germany . | |
| 2471679 | 6/1981 | France | 343/700 MS |
| 207703 | 11/1984 | Japan | 343/700 MS |

*Primary Examiner*—William L. Sikes
*Assistant Examiner*—Michael C. Wimer
*Attorney, Agent, or Firm*—Burns, Doane, Swecker & Mathis

[57] ABSTRACT

A plane antenna comprises a stack of a radiator circuit, first and second power supply circuits and earthing conductor member which are disposed independent of one another with dielectric layers respectively interposed between them, wherein patch elements of the radiator circuit which are respectively disposed in each of slots made in the circuit are electromagnetically coupled to power supplying terminals of the both power supplying circuits rather than directly connecting them, whereby the radiator circuit and power supply terminals are freed from the necessity of direct connection between them as well as the impedance matching between them, so as to eventually improve the assembling ability to a large extent.

5 Claims, 5 Drawing Sheets

GAIN (dB)
24
20
19
14
9
4
X1h
Y2v
X2h
Y1v
11
12
13
FREQUENCY

X-pol (dB)
20
10
0
Xxp
Yxp
11
12
13
FREQUENCY

PLANAR ANTENNA WITH PATCH ELEMENTS

BACKGROUND OF INVENTION

This invention relates to planar antennas and, more particular, to a planar antenna having first and second power supply circuits which provide power supplies for polarizations in different directions.

The planar antennas of the kind referred to are effectively utilized in receiving polarizations which are transmitted on SHF band, that is, a band higher than 12 GHz, from a geostationary broadcasting satellite launched into cosmic space to be 36,000 Km high from the earth.

DISCLOSURE OF PRIOR ART

While parabolic antennas erected on the roof of buildings have been generally utilized as antennas for receiving such microwaves as circularly polarized waves from the geostationary broadcasting satellite, the parabolic antennas have been defective in that they are bulky and susceptible to being blown down by strong wind so that means for stably supporting them must be additionally provided; such supporting means further requires mounting costs and installation labor.

In attempt to eliminate these problems of the parabolic antennas, there has been suggested in Japanese Patent Application Laid-Open Publication No. 99803/1982 (corresponding to U.S. Pat. No. 4,475,107 or German Offenlegungsschrift No. 31 49 002) a planar antenna which is flattened in the entire configuration, whereby the structure can be much simplified and can be mounted inexpensively on an outdoor wall of buildings.

On the other hand, the planar antenna is required to be of a high gain, for which purpose various attempts have been made to reduce insertion loss. Disclosed in, for example, U.S. Pat. No. 4,477,813 by Michael A. Weiss is a planar antenna in which a first dielectric substrate having thereon a power-supply line circuit is fixedly mounted on a ground conductor. A second dielectric substrate having thereon a radiator circuit is space from the first dielectric substrate to form a space between the substrates, and a honeycomb-shaped dielectric is provided between the two dielectric substrates. It is attempted in this planar antenna to reduce the insertion loss in contrast to known antenna arrangements of the type having the radiator and power-supply line circuits directly embedded in a dielectric layer, by disposing the radiator circuit within the space.

This arrangement of Weiss, however, has presented a problem in that the power-supply line circuit is provided not in the space but rather directly on the second dielectric substrate disposed on the ground conductor, so that the insertion loss in a zone of the power-supply line circuit is still large to give an affection to the function of the radiator circuit zone, which results in that the overall insertion loss of the antenna cannot be reduced to a satisfactory extent.

According to another U.S. patent application Ser. No. 15,009 of K. Tsukamoto et al (to which U.K. Patent Application No. 87 03640, German Patent Application No. P 37 06 051.1 or French Patent Application No. 87 02421 corresponds), there has been suggested a planar antenna in which the power-supply circuit and radiator circuit are both coated on their surface with a synthetic resin and the both circuits as well as the ground conductor are respectively separated from one another through a space-retaining means for operating them with a magnetic coupling. With this arrangement, the power supply circuit can be also disposed in the space and retained so as to minimize the insertion loss, whereby the assembling ability can be improved, the conventional problems involved in the plane antennas can be eliminated and thus the high gain can be attained.

Now, in these days where the satellite broadcasting has been put in practice, the number of the geostationary satellites which can be launched is limited, it is required to employ such signals of two different polarization modes at the same frequency as concurrently left-handed and right-handed circularly polarized waves or concurrently horizontally and vertically polarized waves so as to double the signal utilization factor. For this purpose, it is required to provide in the plane antenna two different power supply circuits adaptable to the different polarization modes, and Blere Dietmer has suggested in German Offenlegungsschrift No. 35 14 880 to provide two power supply circuits with respect to the radiator circuit for improving the utilization factor. In this arrangement of Dietmer, however, the radiator circuit and first and second power supply circuits are so formed as to be mutually directly connected only through a connecting pin and, since this connection is to be made normally through a foil-shaped conducting member, the required connecting work is rather complicated. Since an impedance matching between both circuits to be connected is still called for, the assembling ability is poor.

FIELD OF INVENTION

It is an object of the present invention, therefore, to provide a planar antenna for transmitting and receiving signals of the different polarization modes, which has minimized the loss to maintain a sufficiently high antenna gain, while any direct electrical connection is made unnecessary to improve the assembling ability and thus to acquire a high mass producibility with a simpler arrangement.

According to the present invention, this object can be attained by providing a planar antenna including a radiator circuit, power supply circuits and ground conductor member which are disposed respectively to be independent of one another with a dielectric member disposed between them, the radiator circuit including many slots in each of which patch elements which are electromagnetically coupled to corresponding power supply terminals of the power supply circuit so that the polarized waves transmitted from the satellite as carried on SHF band can be received, wherein first and second power supply circuits each including a power supply network of which power supply terminals are arranged to mutually arranged to correspond to different polarization modes are provided, and the power supply terminals corresponding to the different polarization modes of the respective first and second power supply circuits are electromagnetically coupled to the patch elements in the respective slots of the radiator circuit.

Other objects and advantages of the present invention shall be made clear in following description of the invention made with reference to embodiments shown in accompanying drawings.

While the present invention shall now be explained with reference to the embodiments shown in the accompanying drawings, it should be appreciated that the intention is not to limit the present invention only to the embodiment shown but is to rather include all alterations, modifications and equivalent arrangement possible within the scope of appended claims.

DISCLOSURE OF PREFERRED EMBODIMENT

Figure 1:
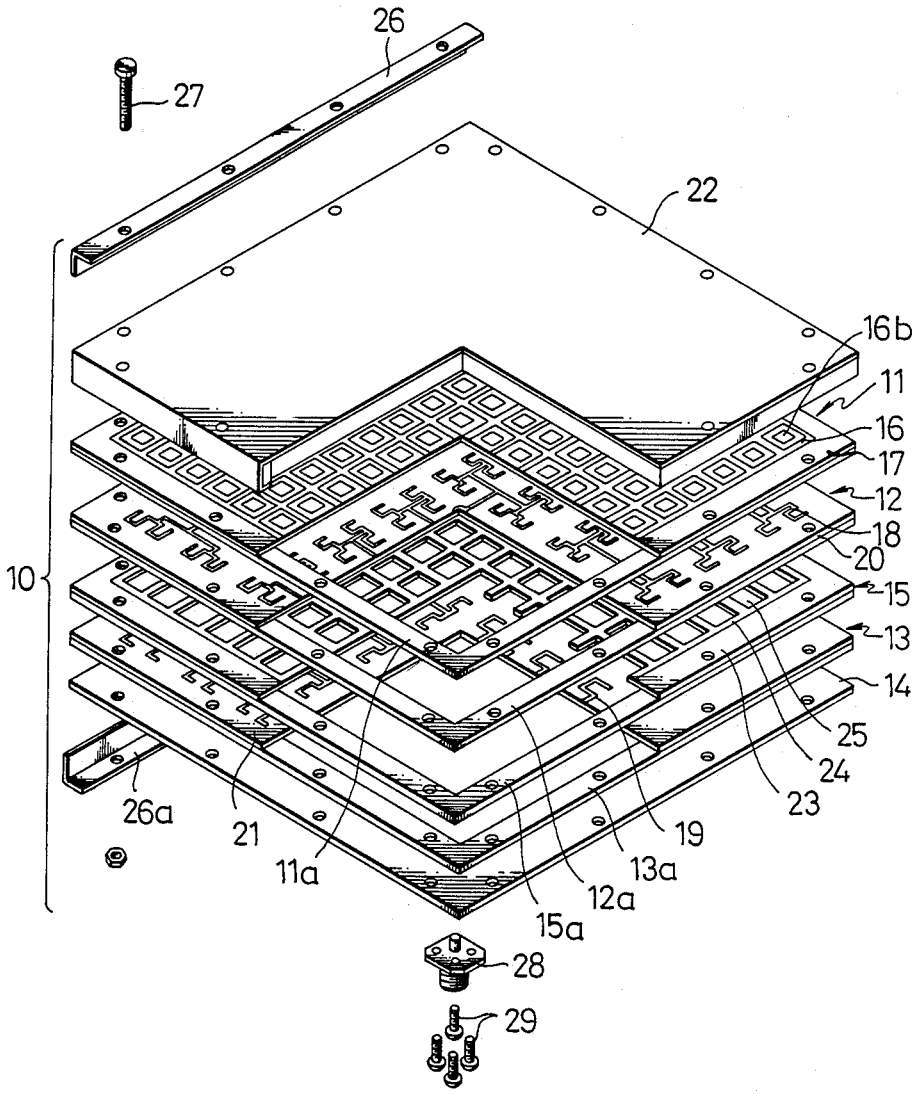
FIG. 1 is a perspective view as disassembled of a plane antenna in an embodiment of the present invention.
Figure 2:
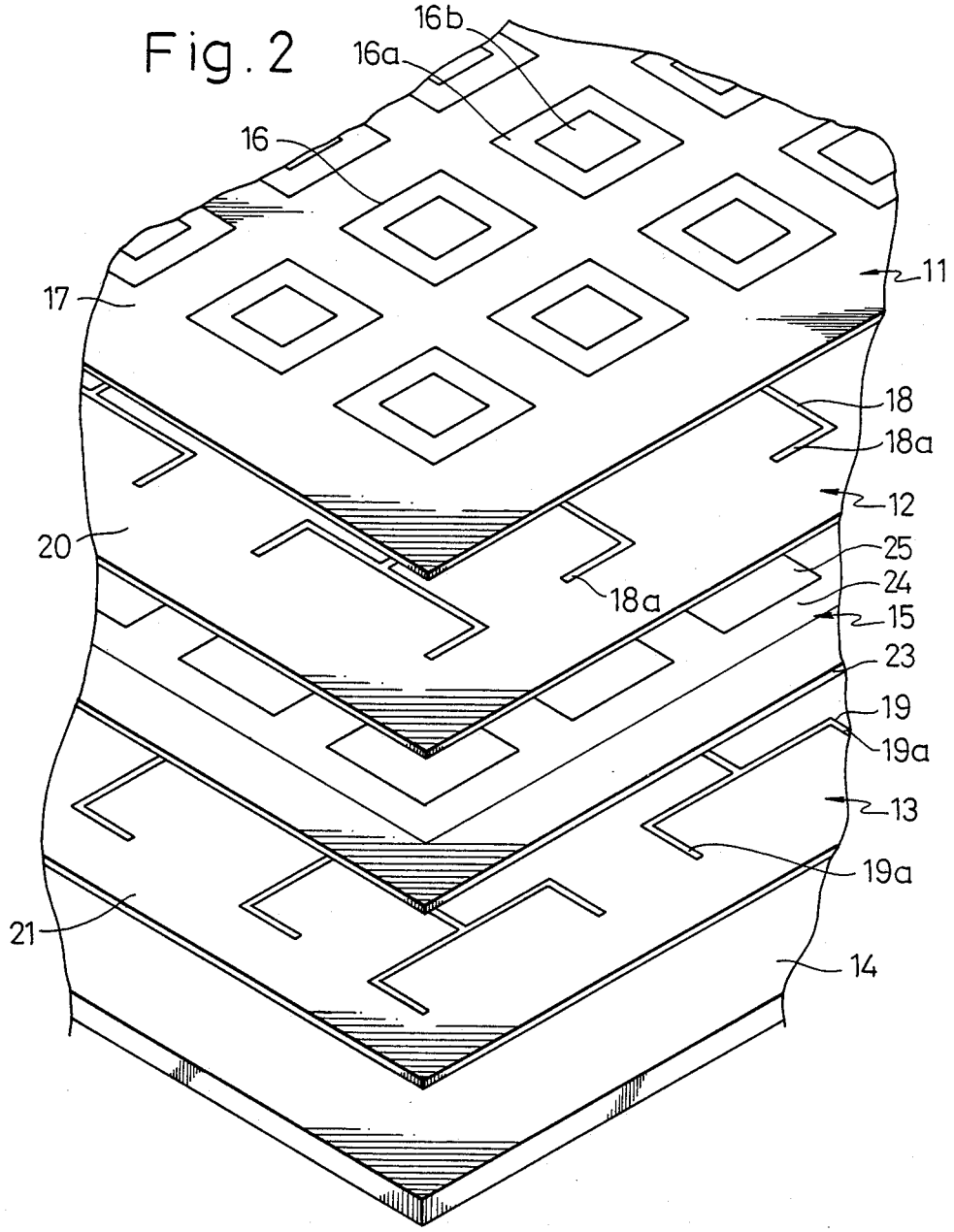
FIG. 2 is a fragmentary perspective view as magnified of the plane antenna of FIG. 1.
Figure 3:
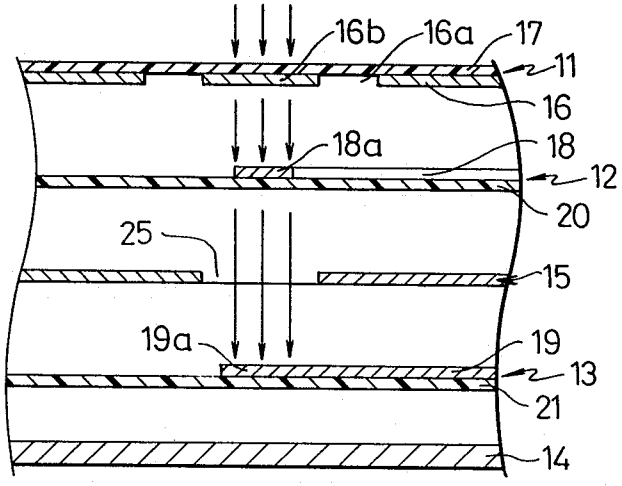
FIG. 3 is a fragmentary sectioned view as magnified of the antenna of FIG. 1.

Referring to FIGS. 1 to 3, a planar antenna 10 according to the present invention comprises a radiator circuit 11, first and second power supply circuit plates 12 and 13 and a ground conductor plate 14. Preferably, a ground circuit plate 15 is inserted between the first and second power supply circuit plates 12 and 13.

More specifically, the radiator circuit plate 11 includes a radiator network 16 formed by such conductive material as copper, aluminum, silver, astatine, iron, gold and the like on a surface of a synthetic resin layer 17, which network 16 is preferably covered on its surface with another synthetic resin layer (not shown), so as to be interposed between the resin layers. As the material for these resin layers, one or at least two admixtures of polyethyrene, polyester, acrylic resin, polycarbonate, ABS and PVC may be employed. The power supply circuit plates 12 and 13 include respectively power supply networks 18 and 19 which are formed by similar conductive material to that of the radiator network 16, on a surface of synthetic resin layers 20 and 21 of the same material as the resin layer 17 of the radiator circuit plate 11. It is preferable that these power supply networks 18 and 19 are also covered on one surface respectively with another synthetic resin layer (not shown) so that the networks 18 and 19 will be interposed between two synthetic resin layers. The ground conductor plate 15 is formed of, for example, aluminum or the same conductive material as described above and is covered by a synthetic resin layer preferably on both surfaces or on one surface.

Further, it is also preferable that the radiator circuit plate 11 is provided on its top or front side surface with such a protective member 22 as a radome made of a foamed plastic material.

Figure 4:
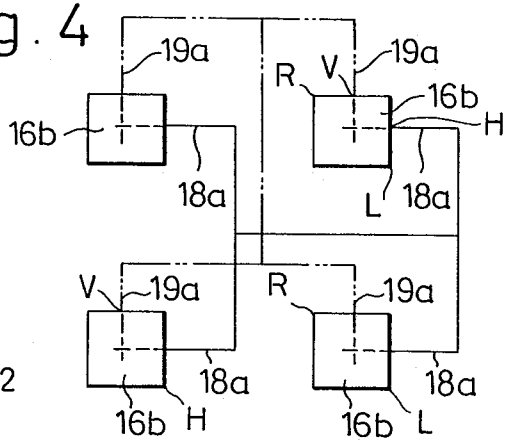
FIGS. 4 and 5 are explanatory views of aspects of the antenna in which same is adapted to different polarization modes.

The radiator network 16 of the radiator circuit plate 11 comprises a plurality of slots 16*a* which are provided on one surface of the synthetic resin layer 17 so that a patch element 16*b* will be disposed in the respective slots 16*a*. The power supply networks 18 and 19 of the power supply circuit plates 12 and 13 are formed respectively to have power supply terminals 18*a* and 19*a* corresponding in number to the slots 16*a* and patch elements 16. In this case, the power supply terminals 18*a* and 19*a* of the networks 18 and 19 are disposed respectively between each of the patch elements 16*b* and the ground conductor plate 14 so as to correspond respectively to each of the different polarization modes with respect to the patch elements 16*b*. That is, referring to FIG. 4, the respective patch elements 16*b* of the radiator network 16 and respective pairs of the power supply terminals 18*a* and 19*a* are so disposed to be superposed on one another that, in a plan view, both tip ends of the terminals 18*a* and 19*a* will pass respectively through central points H and V of two adjacent sides of opposing patch element 16*b* while extending in directions perpendicular to each other. It is thus possible to have the power supply network 18 including the terminals 18*a* adapted to the horizontally polarized mode signals and the other power supply network 19 including the terminals 19*a* adapted to the vertically polarized mode signals. If on the other hand the patch elements and power supply elements are disposed to be superposed on one another so that the tip ends of the terminals 18*a* and 19*a* will pass respectively through both end corner points R and L of the two adjacent sides of each patch element 16*b*, then the power supply network 18 including the terminals 18*a* can be adapted to the right-handed circularly polarized wave mode signals while the power supply network 19 including the terminals 19*a* can be adapted to the left-handed circularly polarized wave mode signals.

Figure 5:
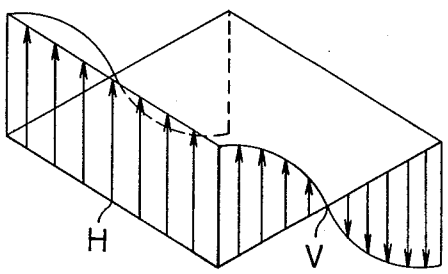

Each side edge of each patch element 16*b* is set preferably to have the length of $\lambda g/2$ ($\lambda g$ being a product of a received wave's wavelength and wavelength-shortening factor), and current distribution generated by means of the wave's polarization plane is considered to be such as shown by arrows in FIG. 5. Accordingly, it is possible to smoothly receive both of the horizontally and vertically polarized waves concurrently when the patch elements 16*b* and power supply terminals 18*a* and 19*a* are positioned to be electromagnetically coupled to each other so as to achieve such mutual relationship that the terminals can obtain the received wave signals from the central points H and V of the adjacent two sides of the respective patch elements 16*b*, as noted above.

Further, it is optimum to dispose between the first and second power supply circuit plates 12 and 13 the ground circuit plate 15, the latter comprising a synthetic resin layer 23 which may be of the same material as that of the foregoing synthetic resin layers, and a ground circuit 24 formed on the resin layer 23 of the same conductive material as the foregoing networks. The circuit plate 15 may be also covered on its top or front side with another synthetic resin layer. The ground circuit 24 is formed to have slots 25 respectively of the same size as the outer dimension of the patch element 16*b* or of a size larger than that. The ground circuit 24 disposed between the first and second power supply networks 18 and 19 effectively restrains any electromagnetic coupling between other regions than the power supply terminals 18*a* and 19*a* of the power supply networks 18 and 19, and functions to enhance the cross, that is, any difference in, for example, the reception level between the horizontally polarized waves and vertically polarized waves when the both power supply networks 18 and 19 are adapted concurrently to the different polarization mode signals. As a result any radio interference between the horizontally and vertically polarized waves can be substantially completely removed. The quantity of slots 25 of the ground circuit 24 is the same as the slots 16*a* as well as the patch elements 16*b* of the foregoing radiator network 16. When, in this case, the size of the slot 25 is smaller than the outer dimension of the patch element 16*b*, it becomes difficult to achieve the electromagnetic coupling between the patch elements 16*b* and the power supply terminals 18*a* and 19*a*. However, if the size of the slots 25 is excessively larger than the patch element the power supply networks 18 and 19 may be easily electromagnetically coupled even at regions other than the power supply terminals. Preferably, the maximum size of the slots 25 should be the same as that of the slots 16*a* of the radiator network 16.

In the event that the width of the conductive material forming the power supply networks 18 and 19 is about 2.0 mm or less, the synthetic resin layers of the first and second power supply circuit plates 12 and 13 each have a thickness of 200 μm or preferably 10 to 100 μm. The radiator circuit plate 11, first and second power supply circuit plates 12 and 13, ground circuit plate 15 and ground conductor plate 14 are spaced from one another with an optimum spacer interposed between them to separate them for more than 0.5 mm preferably. Such spacers may comprise square-shaped frame members 11*a*, 12*a*, 13*a* and 15*a* which about peripheral sides of the respective plates as shown. The frame members may comprise a foamed resin sheet of a foaming rate of more than 5 times so as to have a specific dielectric factor $\gamma\epsilon$ less than 1.3 and provided with sequentially arranged cavities or openings, or the like.

The main part of the planar antenna 10 can be assembled by sequentially stacking the radiator, first and second power supply and ground circuit plates 11, 12, 13 and 14 respectively with the spacers each interposed between them, fitting the protective member 22 thereover, mounting frame members 26 and 26*a* (only part of which is shown) to the periphery of the stacked plates and spacers along upper and lower side edges of them with longitudinal ends of the frame members butted together at respective corners of the stacked plates and spacers, and fastening the upper and lower frame members 26 and 26*a* to each other by means of bolts and nuts 27, the bolts having been passed through the frame members and the stacked plates and spacers. To the power supply networks 18 and 19 of the first and second power supply circuit plates 12 and 13, a power supply pin 28 is mounted by means of screws 29 which are conductive. An external power supply cable is connected to the pin 28. While the power supply pin 28 may be connected directly to the networks 18 and 19, it is preferable to attain the power supply by means of the electromagnetic coupling of the pin to the networks 18 and 19.

EXAMPLE 1

A radiator circuit plate was prepared by forming on a commercially available flexible print plate a plurality of square slots each having a side length of 16 mm to be in arrays. Patch elements of 8 mm square are disposed in the respective slots. The 256 patch elements forming radiating elements are separated from one another by 24 mm. A first power supply circuit plate was prepared by forming on another commercially available flexible print plate a power supply network so as to be electromagnetically coupled to the respective patch elements in the lateral direction with respect to their parts from their central point to a side so as to be adapted to the horizontal polarization mode, and a second power supply circuit plate was prepared by forming on still another flexible print plate a power supply network to be electromagnetically coupled to the respective patch elements in vertical direction with respect to their parts from the central point to a side to be adapted to the vertical polarization mode. An aluminum plate of 2 mm thick and available in the market was employed as an earthing conductor plate.

The respective plates thus obtained were stacked on each other with spacers each interposed between the respective plates, the spacers being of 2 mm thick foamed polystyrene sheet having cavities formed in arrays, and a plane antenna was obtained.

EXAMPLE 2

A plane antenna was obtained with the same arrangement as the above Example 1, except that its earthing circuit plate was prepared by forming, on the flexible print plate available in the market, 256 pieces of slots having a side length of 16 mm in arrays respectively at positions matching with the slots and patch elements in the radiator network and this earthing circuit plate was disposed between the first and second power supply circuit plates.

Figure 6:
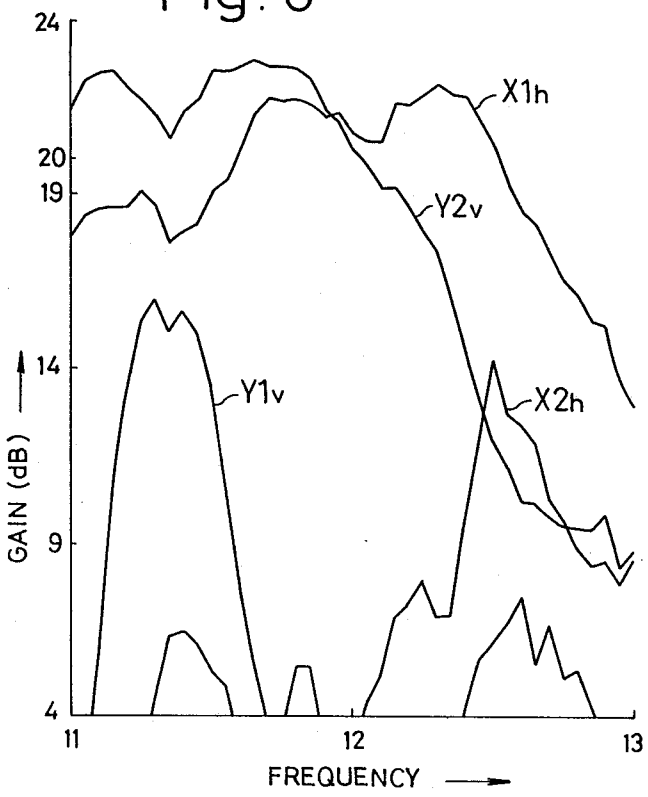
FIG. 6 is a diagram graphically showing relationship between the transmission frequency and the gain in basic arrangement of the plane antenna according to the present invention.
Figure 7:
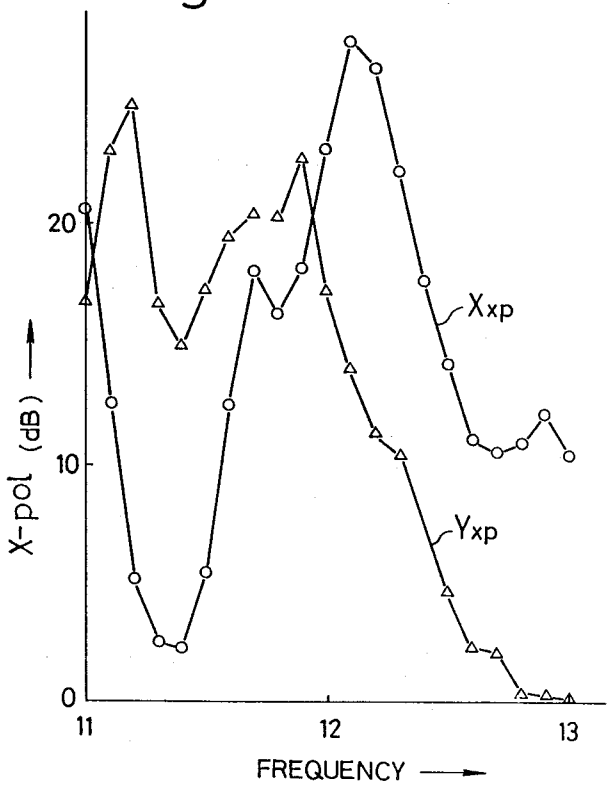
FIG. 7 is a diagram graphically showing relationship between the transmission frequency and the cross polar (cross polarization characteristics or polarization isolation characteristics) in the basic arrangement similar to FIG. 6.

The plane antenna of Example 1 was subjected to measurement of the gain for the horizontally and vertically polarized waves at the first power supply network while varying the transmitted wave frequency, and such results as represented by curves X1h and Y1v of FIG. 6, respectively. The antenna was further subjected to measurement of the gain also for the horizontally and vertically polarized waves at the second power supply network, results of which were as represented by curves X2h and Y2v, respectively. The cross polar (X-pol) with respect to the transmitted frequency was obtained and such results as shown by curves Xxp and Yxp of FIG. 7, respectively, were obtained for the first and second power supply networks. With these results, it has been found that the cross polar of more than 15 dB can be obtained at 11.6 to 12.0 GHz.

Figure 9:
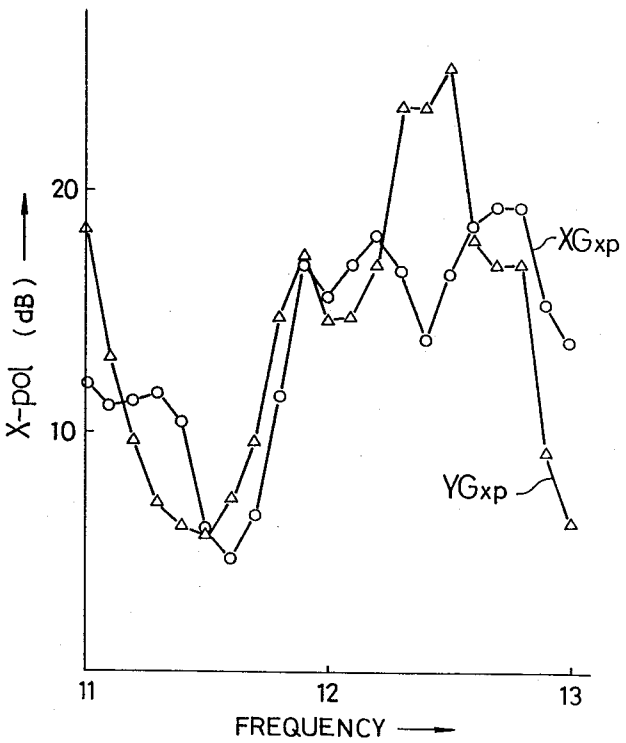
FIG. 9 shows graphically relationship between the transmission frequency and the cross polar in the plane antenna of FIG. 1 to which the earthing circuit is added.
Figure 8:
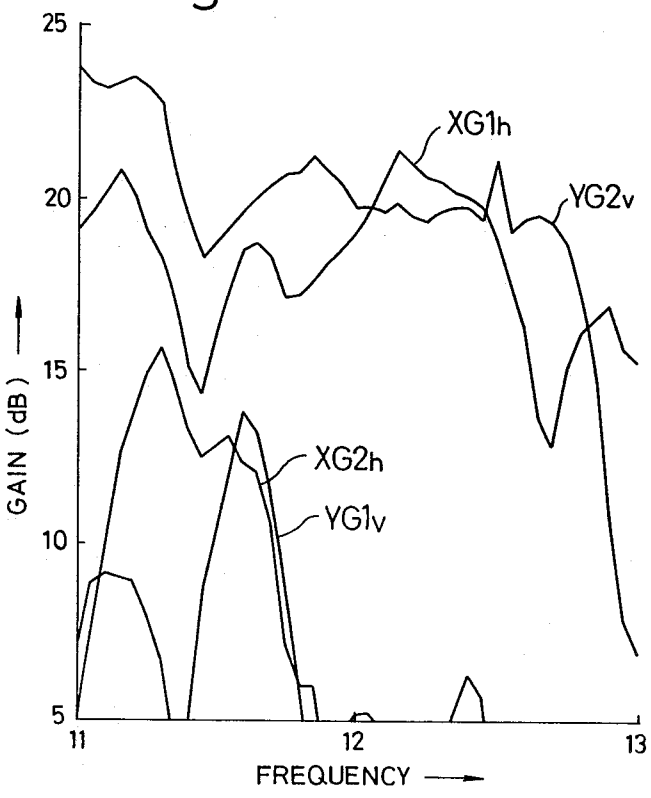
FIG. 8 graphically shows relationship between the transmission frequency and the gain in the plane antenna of FIG. 1 of the present invention to the basic arrangement of which an earthing circuit is further added.

The plane antenna of Example 2 was also subjected to the measurement of the gain for the horizontally and vertically polarized waves at the first power supply network while varying the transmitted frequency, results of which were as represented by curves XG1h and YG1v of FIG. 8. Similar measurement of the gain for the horizontally and vertically polarized waves at the second power supply network reached such results as shown by curves XG2h and YG2v of FIG. 8, while the cross polar (X-pol) with respect to the transmitted frequency was as represented by curves XGxp and YGxp of FIG. 9 for the first and second power supply networks, respectively. With these results, it has been found that the cross polar of above 15 dB can be obtained at 11.9 to 12.8 GHz, that is, the operating band of this antenna can be made wider than that of Example 1.

What we claim as our invention is:

1. A planar antenna for concurrently receiving signals transmitted from a satellite in different polarization modes as carried on SHF band, comprising:

a radiator circuit plate formed of a resin and carrying a radiator circuit of a conductive material and including a plurality of slots and a plurality of square-shaped patch elements disposed in respective ones of said slots, first and second power supply circuit plates formed of a resin and respectively carrying first and second power supply circuits of a conductive material, said first power supply circuit including a plurality of first terminals disposed to correspond to one of said polarization modes, there being a first terminal for each said patch element, said second power supply circuit including a plurality of second terminals disposed to correspond to another of said polarization modes, there being a second terminal for each said patch element, said first and second power supply circuits being separated from each other and from said radiator circuit to be independent of one another, with power supply terminals of each of said first and second power supply circuits being superposed relative to respective ones of said patch elements for electromagnetically coupling each of said patch elements with a power supply terminal of said first power supply circuit and with a power supply terminal of said second power supply circuit, and a ground conductor plate separated from said radiator circuit and said first and second power supply circuits to be independent thereof, said first terminals being arranged in a plurality of pairs, and said second terminals being arranged in a plurality of pairs, each pair of first terminals being arranged to bisect respective sides of two adjacent ones of said patch elements, each pair of second terminals being arranged to bisect respective sides of two adjacent ones of said patch elements, as said antenna is viewed in plan, such that the first and second terminals associated with each patch element are oriented perpendicularly to one another in such manner that said first and second power supply circuits correspond to horizontal and vertical polarization modes, respectively, said ground conductor plate being formed of a resin and carries a ground circuit of a conductive material, said ground conductor plate being disposed between said first and second power supply circuits and separated from them, said ground circuit including a plurality of slots at least as large as respective ones of said patch elements and disposed at positions superposed relative to said patch elements.

2. A planar antenna according to claim 1, wherein said radiator circuit plate is covered on an outer side opposite to said first power supply circuit plate by a protective member including a foamed resin layer.

3. A planar antenna according to claim 1, wherein said slots of said ground circuit are also square-shaped.

4. A planar antenna according to claim 1 including a plurality of spacers formed of foamed resin and including a plurality of cavities, a first of said spacers disposed between said first and second power supply circuit plates, and a second of said spacers disposed between said radiator circuit plate and the nearest one of said power supply circuit plates.

5. A planar antenna according to claim 4, wherein said radiator circuit plate is covered on an outer side opposite to said first power supply circuit plate by a protective member including a foamed resin layer.

* * * * *